US009615615B2

(12) United States Patent
Slank

(10) Patent No.: US 9,615,615 B2
(45) Date of Patent: Apr. 11, 2017

(54) GARMENTS WITH AIR CIRCULATION INDUCING ARRANGEMENT

(76) Inventor: Adam E. Slank, Austin, TX (US)

( * ) Notice: Subject to any disclaimer, the term of this patent is extended or adjusted under 35 U.S.C. 154(b) by 79 days.

(21) Appl. No.: 13/345,897

(22) Filed: Jan. 9, 2012

(65) Prior Publication Data

US 2013/0174315 A1 Jul. 11, 2013

(51) Int. Cl.

| | |
|---|---|
| ***A41D 27/20*** | (2006.01) |
| ***A41D 27/28*** | (2006.01) |
| *A41D 1/06* | (2006.01) |

(52) U.S. Cl.

CPC ..... *A41D 27/28* (2013.01); *A41D 1/06* (2013.01)

(58) Field of Classification Search

CPC ..... A41D 27/20; A41D 27/28
USPC ..... 2/247, DIG. 1
See application file for complete search history.

(56) References Cited

U.S. PATENT DOCUMENTS

| | | | | |
|---|---|---|---|---|
| 1,657,973 | A * | 1/1928 | Schuhbauer et al. | 2/247 |
| 4,619,004 | A * | 10/1986 | Won | 2/227 |
| 4,731,883 | A * | 3/1988 | Foster | 2/69 |
| 5,105,477 | A * | 4/1992 | Golde | 2/93 |
| 5,303,424 | A * | 4/1994 | Cromartie | 2/67 |
| 5,507,042 | A * | 4/1996 | van der Slessen | 2/69 |
| 5,704,064 | A * | 1/1998 | van der Sleesen | 2/69 |
| 5,727,256 | A * | 3/1998 | Rudman | 2/115 |
| 5,845,336 | A * | 12/1998 | Golde | 2/93 |
| 6,263,510 | B1 * | 7/2001 | Bay et al. | 2/93 |
| 6,442,760 | B2 * | 9/2002 | Moretti | 2/115 |
| 6,795,976 | B1 * | 9/2004 | van der Sleesen | 2/69 |
| 6,883,178 | B2 * | 4/2005 | van der Sleesen | 2/69 |
| 6,941,584 | B1 * | 9/2005 | Matthews | 2/234 |
| 7,017,191 | B2 * | 3/2006 | Golde | 2/93 |
| 7,043,767 | B2 * | 5/2006 | Jaeger | 2/87 |
| 2008/0256690 | A1 * | 10/2008 | Grilliot et al. | 2/455 |

* cited by examiner

*Primary Examiner* — Sally Haden
(74) *Attorney, Agent, or Firm* — David O. Simmons

(57) ABSTRACT

A garment worn over a portion of a body of a wearer comprises a garment wall and an airflow inducer. The garment wall has a first garment wall airflow passage extending therethrough. The airflow inducer is attached to an exterior surface of the garment wall over the first garment wall airflow passage such that the airflow inducer encompasses the first garment wall airflow passage. The airflow inducer and the garment wall jointly define an air chamber. The first garment wall airflow passage is exposed within the air chamber. The airflow inducer is deformable such that the air chamber has a volume dependent upon a state of deformation of the airflow inducer. An airflow passage of the inducer provides for airflow between the air chamber and an ambient environment surrounding the garment.

13 Claims, 2 Drawing Sheets

GARMENTS WITH AIR CIRCULATION INDUCING ARRANGEMENT

FIELD OF THE DISCLOSURE

The disclosures made herein relate generally to garments and, more particularly, to garments that are configured for enhancing cooling of a person wearing such a garment.

BACKGROUND

A particular garment (e.g., pants, jacket, shirt, overalls, etc) or collection of garments (e.g., uniform including pants and jacket) is typically chosen for accommodating a functional application within a particular ambient environment. However, it is well known that a garment that is preferred for a particular functional application (e.g., bodily protection) is often not a preferred choice for a corresponding ambient environment (e.g., relatively high ambient temperature). For example, a person who requires protection of their skin from potential adverse considerations (e.g., insects, cuts, abrasions, etc) may prefer to wear pants and/or a jacket but the ambient environment (e.g., relatively high temperature and/or humidity) may make garments such as shorts and a shirt a better choice if the ambient environment was the primary consideration in selecting such garments.

In the case of persons engaged in physical work activities, law enforcement activities, military activities and the like, the primary consideration of garment selection is often based on the functional application of bodily protection. As such, this garment selection can often result in the person wearing such garments being provided with bodily cooling that is less than optimal or preferred. In effect, the garment(s) provide for preferred functional application(s) that do not relate to optimal or preferred cooling of the person's body. To the contrary, in many instances, such garment selection will have an adverse affect on the cooling of the person's body (e.g., by limiting conductive, convective, and/or evaporative cooling attributes between the person's body and the ambient environment).

Therefore, a garment that is configured for enhancing bodily cooling of the person via air circulation between an ambient environment surrounding the garment and an air space defined between the person and the garment would be beneficial, desirable and useful.

SUMMARY OF THE DISCLOSURE

Embodiments of the present invention are directed to garments that are configured for enhancing bodily cooling of the person via air circulation through an ambient environment surrounding the garment and an air space defined between the person and the garment. More specifically, embodiments of the present invention can provide for such air circulation via forced convection induced by motion of the person wearing the garment. In preferred embodiments, such garments are further configured to provide coverage over a majority of a length of the appendages of the person wearing the garment.

In one embodiment of the present invention, a garment worn over a portion of a body of a wearer comprises a garment wall and an airflow inducer. The garment wall has a first garment wall airflow passage extending therethrough. The airflow inducer is attached to an exterior surface of the garment wall over the first garment wall airflow passage such that the airflow inducer encompasses the first garment wall airflow passage. The airflow inducer and the garment wall jointly define an air chamber. The first garment wall airflow passage is exposed within the air chamber. The airflow inducer is deformable such that the air chamber has a volume dependent upon a state of deformation of the airflow inducer. An airflow passage of the inducer provides for airflow between the air chamber and an ambient environment surrounding the garment.

In another embodiment of the present invention, a garment worn over a portion of a body of a person comprises a garment wall and an airflow inducer attached to the garment wall. The garment wall is arranged to provide an appendage-receiving space. A first garment wall airflow passage extends through the garment wall thereby allowing for airflow between the appendage-receiving space and an airspace external to the garment. An air chamber is defined between the airflow inducer and the garment wall. A wall of the airflow inducer is deformable such that a volume of the air chamber is dependent upon a state of deformation of the wall of the airflow inducer. The first garment wall airflow passage communicates with the air chamber. An inducer airflow passage provides for airflow between the air chamber and the airspace external to the garment.

In another embodiment of the present invention, pants for being worn by a person comprise a pair of leg sections and a pocket attached to each one of the leg sections. The pair of leg sections each have a respective leg-receiving space therein. A first leg section airflow passage extends through each one of the leg sections thereby allowing for airflow between the leg-receiving space and an airspace defined by an exterior surface of a respective one of the leg sections. The pocket of each one of the leg sections extends over the first leg section airflow passage thereof. Each pocket encompasses the first leg section airflow passage of a particular one of the leg sections. An air chamber is jointly defined by each pocket and a respective one of the leg sections. The first leg section airflow passage of the particular one of the leg sections is exposed within the air chamber thereof. Each one of the pockets includes a deformable wall portion such that the air chamber of each one of the leg sections has a volume dependent upon a state of deformation of the deformable wall portion thereof. Airflow between the air chamber of the particular one of the leg sections and an ambient environment surrounding the pants is provided for by a pocket airflow passage of the pocket of the particular one of the leg sections.

These and other objects, embodiments, advantages and/or distinctions of the present invention will become readily apparent upon further review of the following specification, associated drawings and appended claims.

DETAILED DESCRIPTION OF THE DRAWING FIGURES

Figure 1:
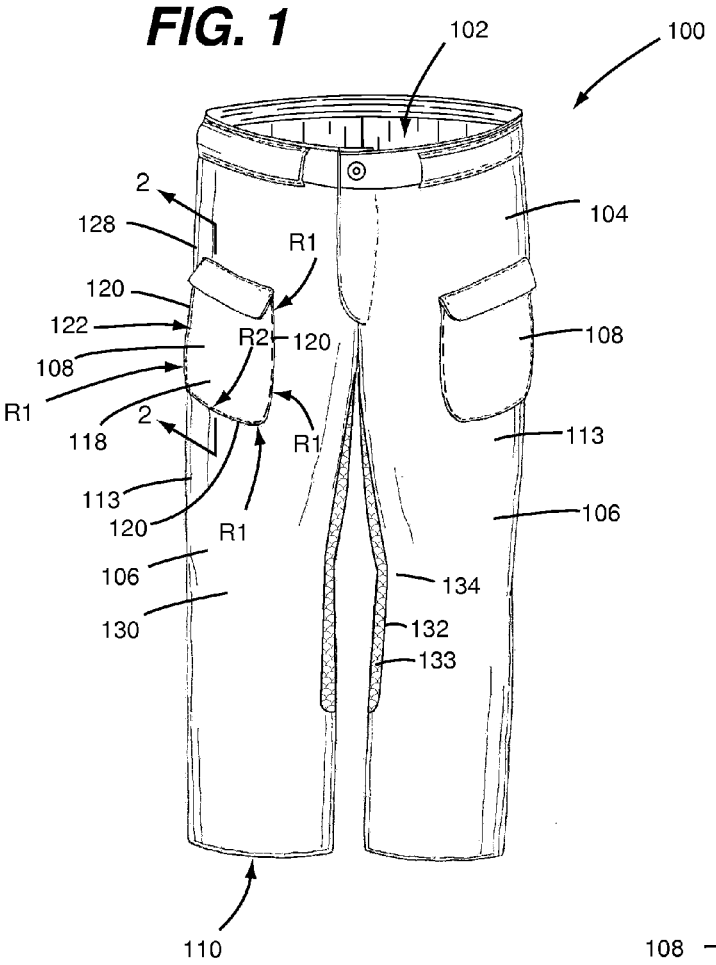
FIG. 1 depicts front view of pants configured for providing air circulation via forced convection through a body-receiving space of the pants in accordance with embodiment of the present invention.
Figure 2:
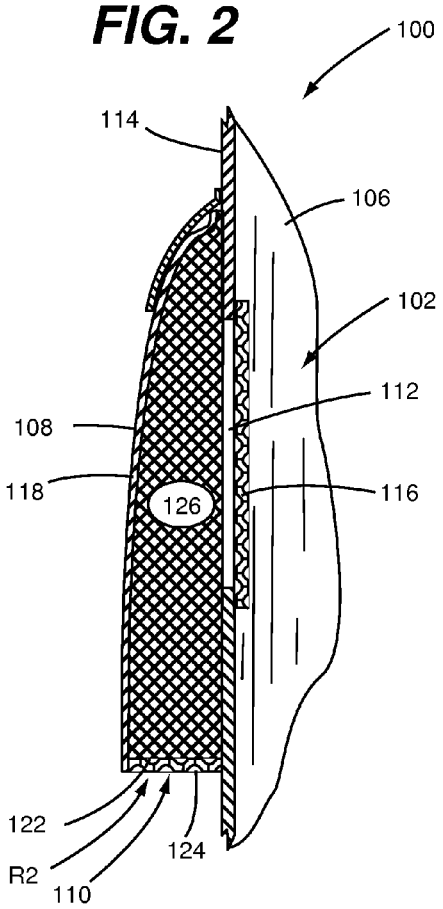
FIG. 2 is a cross sectional view taken along the line 2-2 in FIG. 1.

Referring to FIGS. 1 and 2, pants 100 configured in accordance with an embodiment of the present invention are shown. In accordance with the present invention, the pants 100 provide for enhanced bodily cooling of a person via air circulation through an ambient environment surrounding the pants 100 and an airspace 102 within the pants 100 (i.e., an airspace between the person and the garment when the person is wearing the pants 100). Advantageously, as discussed below in greater detail, the pants 100 provide for such air circulation via forced convection induced by motion of the person wearing the pants. The pants 100 are one example of a garment configured in accordance with the present invention. Furthermore, the pants 100 are an example of garments configured in accordance with the present invention for providing enhanced bodily cooling and for covering a majority of a length of appendage of the person (i.e., the person's legs) while wearing the garment.

Figure 3:
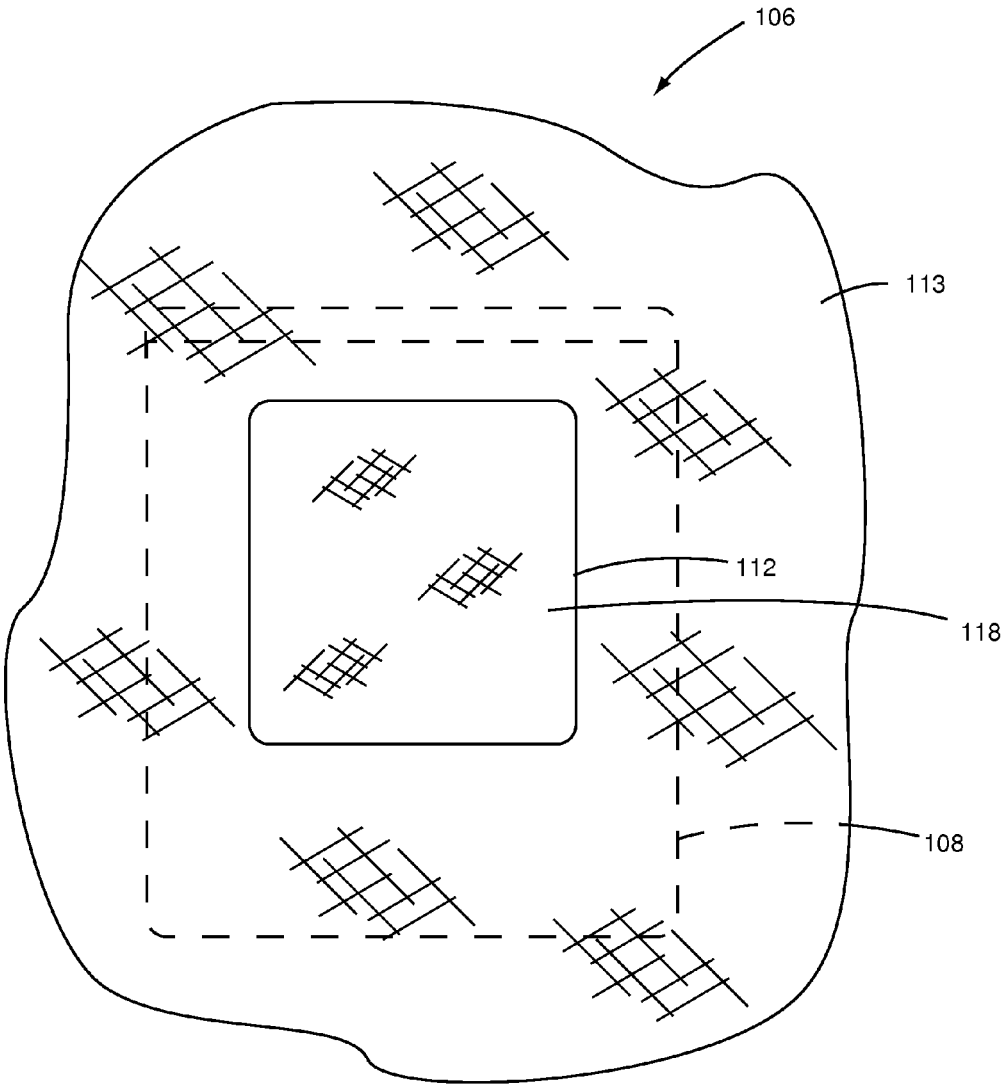
FIG. 3 is a fragmentary view showing relationship of an air inducer front wall with respect to a first garment wall airflow passage of the pants shown in FIG. 1.

The pants 100 include a lower torso section 104, a pair of leg sections 106 connected to the lower torso section 104, and a pocket 108 attached to each one of the leg sections 106. The pair of leg sections 106 each have a respective leg-receiving space 110 therein, each of which is a part of the airspace 102 of the pants 100. A first leg section airflow passage 112 extends through a pant leg wall 113 (i.e., a garment wall) of each one of the leg sections thereby allowing for airflow between the leg-receiving space 110 and an airspace defined by an exterior surface 114 of the corresponding leg section 106. A pant leg mesh panel 116, which is attached to each pant leg wall 113, extends over the first leg section airflow passage 112. As shown in FIG. 3, each pocket 108 includes a front wall 118 that extends over and encompasses an entire area of the corresponding first leg section airflow passage 112. In preferred embodiment, the area of the front wall 118 is greater (e.g., substantially greater) than an entire area of the first garment wall airflow passage 112.

Each front wall 118 is connected along a first region R1 of a perimeter edge portion 120 of the corresponding pocket 108. A pocket airflow passage 122 of each pocket 108 is provided between a second region R2 of the perimeter edge portion 120 thereof and the respective one of the pant leg wall 113. A pocket mesh panel 124, which is attached between each pocket 108 and the corresponding pant leg wall 113, extends over the corresponding pocket airflow passage 122. Accordingly, the pant leg mesh panel 116 and the pocket mesh panel 124 of a particular leg section 106 jointly provides the function of permitting airflow through each pant leg wall 113 and pocket 108 and the function of limiting articles from falling from within the pockets 108 into the leg-receiving space 110 of the corresponding leg section 106.

An air chamber 126 is jointly defined by each pocket 108 and a respective one of the leg sections 106. The first leg section airflow passage 112 of a particular one of the leg sections 106 is exposed within the air chamber 126 of that particular leg section 106. Airflow between each air chamber 126 and an ambient environment surrounding the pants 100 is provided for by the pocket airflow passage 122 of the corresponding leg section 106. The front wall 118 and the pocket mesh panel 124 of each pocket 108 are made from deformable materials. For example, the leg sections 106 and the front wall 118 of the pockets 108 can be made from a woven natural or synthetic fabric material and the mesh panels 116, 124 can be made from a deformable knitted or woven material that has regular openings therethrough (i.e., a mesh material). Accordingly, the air chamber 126 of each one of the leg sections 106 has a volume that is dependent upon a state of deformation of the front wall 118 and/or the pocket mesh panel 124 (i.e., deformable wall portions). In this manner, as a person wearing the pants 100 moves (e.g., walks or runs) while wearing the pants, this motion causes a repeated and/or cyclical change in volume of the air chambers 126 thereby inducing air flow through an airflow circuit including the first leg section airflow passage 112, the air chamber 126, and the pocket airflow passage 122. In effect, each pocket 108 and corresponding pocket mesh panel 124 serves as an air pump (e.g., a bellow) that is energized via movement of the corresponding leg section 106 of the pants 100.

Each one of the leg sections 106 includes a hip joint articulation region 128 and a knee joint articulation region 130. A hip joint region of the leg of the person wearing the garment 100 is located at the hip joint articulation region 128. A knee joint region of the leg of the person wearing the garment 100 is located at the knee joint articulation region 130. In certain embodiments of the present invention, it is preferred for the pocket 108 (i.e., an airflow inducer) to be attached to the pant leg wall 113 adjacent to one of the joint articulation regions 128, 130. For example, the pocket 108 can be attached to the pant leg wall 113 at a location between the hip joint articulation region 128 and the knee joint articulation region 130 such that it is adjacent to both of the joint articulation regions 128, 130.

Referring to FIG. 1, each leg section 106 includes a second leg section airflow passage 132 that extends through the pant leg wall 113. A mesh panel 133 is attached over the second leg section airflow passage 132. In the depicted embodiment, the second leg section airflow passage 132 is located at an inseam region 134 of a particular one of the leg sections 106, which is outside on an area encompassed by the pocket 108 the particular one of the leg segments 106. Accordingly, as can be seen, the first leg section airflow passage 112 and the second leg section airflow passage 132 are located on opposing sides of the leg-receiving space 110 of the particular one of the leg sections 106 (i.e., the first leg section airflow passage 112 at an outseam region and the second leg section airflow passage 132 at an inseam region). It is also disclosed herein that the second leg section airflow passage 132 or another airflow passage can be located at different location of the leg sections 106 of the pants 100 and/or at a location within the lower torso section 104. For example, one or more airflow passages can be located within a portion of the pants that is above or below a buttocks receiving space of the lower torso section 104. Airflow passages that are not covered by an airflow inducer can be covered by a piece of material such as, for example, in the form of a flap.

The pants 100 discussed above are one example of a garment configured in accordance with an embodiment of the present invention. However, the present invention is not unnecessarily limited to any particular type of garment. For example, the pants 100 show how the present invention can be implemented in a garment that is configured for covering lower extremities of a person's body (e.g., hip region (i.e., lower torso) and legs). However, in view of the disclosures made herein a skilled person will appreciate that the present invention can be implemented in a garment that is configured for covering upper extremities of a person's body (e.g., abdomen, chest and arms). For example, a garment in the form of a shirt or jacket and configured in accordance with the present invention can have an airflow inducer located on arm sections, a shoulder section, chest section, and/or back section thereof. Furthermore, such a garment can have airflow passages that are not encompassed by an airflow inducer located at one or more other locates of the garment (e.g., at an arm-pit area, shoulder area, chest area, and/or the like).

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A garment adapted to be worn over a portion of a body of a wearer, comprising:

a garment wall having a first garment wall airflow passage extending therethrough; and an airflow inducer attached to an exterior surface of the garment wall over the first garment wall airflow passage, wherein a front wall of the airflow inducer extends over and encompasses the first garment wall airflow passage, wherein an upper perimeter edge portion of the front wall is attached to the garment wall at a first location on the garment wall that is offset from an upper perimeter edge portion of the first garment wall airflow passage, and a lower perimeter edge portion of the front wall is indirectly attached to the garment wall at a second location on the garment wall that is offset from a lower perimeter edge portion of the first garment wall airflow passage such that a first space extends between the upper perimeter edge portion of the front wall and the upper perimeter edge portion of the first garment wall airflow passage and a second space extends between the lower perimeter edge portion of the front wall and the lower perimeter edge portion of the first garment wall airflow passage, wherein a mesh panel of the airflow inducer spans between the second location on the garment wall and the lower perimeter edge portion of the front wall, wherein an end of said mesh panel is fixedly and directly attached to the second location on the garment wall and an opposite end of said mesh panel is fixedly and directly attached to the lower perimeter edge portion of the front wall, such that the lower perimeter edge portion of the front wall of the airflow inducer is spaced from the garment wall by the mesh panel, wherein an air chamber is jointly defined by the front wall, the mesh panel and the garment wall, wherein the front wall of the airflow inducer, the mesh panel of the airflow inducer, and the garment wall jointly define a pocket, such that the front wall of the pocket is attached directly to both the mesh panel and to the garment wall, wherein the front wall and the mesh panel are made from a respective deformable material to allow a volumetric space of the air chamber to be dependent upon a change in shape of at least one of the front wall and the mesh panel, wherein the mesh panel defines at least a portion of a bottom of the air chamber, wherein the first garment wall airflow passage is exposed within the air chamber, wherein an airflow passage of the airflow inducer, the air chamber, and the first garment wall airflow passage are adapted to jointly define an airflow pathway between the air chamber and an ambient environment surrounding the garment, and wherein at least a portion of the airflow passage of the airflow inducer is located outside of the perimeter edge portion of the first garment wall airflow passage.

2. The garment of claim 1 wherein a height of the front wall is substantially greater than a height of the garment wall airflow passage.

3. The garment of claim 1 wherein the front wall and the garment wall define opposing walls of the air chamber.

4. The garment of claim 1 wherein:

the garment wall includes a plurality of appendage joint articulation regions at which a respective articulating joint of an appendage of the wearer is adapted to be located while wearing the garment; and the airflow inducer is attached to the garment wall adjacent to at least one of said appendage joint articulation regions.

5. The garment of claim 1 wherein the garment wall includes a second garment wall airflow passage extending through the garment wall at a location of the garment wall outside on an area of the garment wall encompassed by the airflow inducer.

6. The garment of claim 5 wherein:

the garment wall is arranged to provide an appendage-receiving space in which an appendage of the wearer is adapted to be located while wearing the garment;

the first garment wall airflow passage is located at a first region of the garment wall;

the second garment wall airflow passage is located at a second region of the garment wall; and the first region of the garment wall and the second region of the garment wall are on opposing sides of the appendage-receiving space.

7. Pants adapted for being worn by a person, comprising:

a pair of leg sections each one of said leg sections having a respective leg-receiving space therein, wherein each one of said leg sections has a first leg section airflow passage extending therethrough thereby allowing for airflow between the leg-receiving space and an airspace defined by an exterior surface of a respective one of the leg sections; and a pocket attached to each one of the leg sections over the first leg section airflow passage thereof, wherein a front wall of the pocket of the respective one of the leg sections extends over and encompasses the first leg section airflow passage thereof, wherein an upper perimeter edge portion of the front wall is attached to the respective one of the leg sections at a first location on the respective one of the leg sections, the first location being offset from an upper perimeter edge portion of the first leg section airflow passage, and a lower perimeter edge portion of the front wall is indirectly attached to the respective one of the leg sections at a second location on the respective one of the leg sections, the second location being offset from a lower perimeter edge portion of the first leg section airflow passage such that a first space extends between the upper perimeter edge portion of the front wall and the upper perimeter edge portion of the first leg section airflow passage and a second space extends between the lower perimeter edge portion of the front wall and the lower perimeter edge portion of the first leg section airflow passage, wherein at least a portion of the perimeter edge portion of the front wall is attached to the respective one of the leg sections at a location substantially outside of a perimeter edge portion of the first leg section garment wall airflow passage thereof, wherein each pocket includes a mesh panel, wherein the mesh panel spans between the second location on the respective one of the leg sections and the lower perimeter edge portion of the front wall, wherein an end of said mesh panel is fixedly and directly attached to the second location on the respective one of the leg sections and an opposite end of said mesh panel is fixedly and directly attached to the lower perimeter edge portion of the front wall, such that the lower perimeter edge portion of the front wall is spaced from the respective one of the leg sections by the mesh panel, wherein an air chamber is jointly defined by the front wall and mesh panel of each pocket and the respective one of the leg sections, such that the front wall is attached directly to both the mesh panel and to the respective one of the leg sections, wherein the front wall and the mesh panel are made from a respective deformable material to allow a volumetric space of the air chamber to be dependent upon a change in shape of at least one of the front wall and the mesh panel, wherein the mesh panel defines at least a portion of a bottom of the air chamber, wherein the first leg section airflow passage of the respective one of the leg sections is exposed within the air chamber thereof, wherein the front wall of each one of the pockets is a deformable wall portion, and wherein at least a portion of a pocket airflow passage of the respective one of the leg sections is located outside of an entire area of the first leg section airflow passage thereof.

8. The pants of claim 7 wherein:

a height of the front wall of the pocket attached to the respective one of the leg sections is substantially greater than a height of the first leg section airflow passage thereof; and the front wall and the respective one of the leg sections define opposing walls of the air chamber.

9. The pants of claim 8 wherein:

the front wall of each pocket and each one of the leg sections are made from deformable woven fabric;

a bottom edge of the front wall of the pocket of the respective one of the leg sections is attached to the respective one of the leg sections at a location substantially outside of the area defined by the perimeter edge portion of the first leg section airflow passage thereof;

the bottom edge of the front wall defines an edge of the airflow passage of the pocket; and each one of the pockets includes a deformable mesh panel covering the pocket airflow passage thereof.

10. The pants of claim 7 wherein:

each one of the leg sections includes a plurality of appendage joint articulation regions at which a respective articulating joint of an appendage of the person is adapted to be located while wearing the pants; and the pocket is attached to the respective one of the leg sections adjacent to at least one of said appendage joint articulation regions.

11. The pants of claim 7 wherein:

each one of the leg sections includes a second leg section airflow passage;

the first leg section airflow passage is located at a first region of the respective one of the leg sections; and the second leg section airflow passage is located at a second region of the respective one of the leg sections.

12. The pants of claim 11 wherein the first and second regions are on opposing sides of the leg-receiving space.

13. The pants of claim 12 wherein:

a height of the front wall of the pocket attached to the respective one of the leg sections is substantially greater than a height of the first leg section airflow passage thereof; and the front wall and the respective one of the leg sections define opposing walls of the air chamber.

* * * * *